US006446391B1

(12) United States Patent
Timothy

(10) Patent No.: US 6,446,391 B1
(45) Date of Patent: Sep. 10, 2002

(54) CASEMENT SASH CABLE ACTUATOR

(75) Inventor: E. Erik Timothy, Macedon, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 09/632,229

(22) Filed: Aug. 4, 2000

(51) Int. Cl.[7] ..... E06B 11/00
(52) U.S. Cl. ..... 49/332; 49/330; 49/364
(58) Field of Search ..... 49/330, 331, 332, 49/324, 325, 376, 377, 168, 169, 176, 364

(56) References Cited

U.S. PATENT DOCUMENTS

| | | | | |
|---|---|---|---|---|
| 1,478,856 A | | 12/1923 | Hockenberry | |
| 1,903,120 A | | 10/1933 | Behnke | 268/62 |
| 2,201,105 A | * | 5/1940 | Fabriani | 49/188 |
| 2,248,337 A | | 7/1941 | Carroll | 268/117 |
| 2,315,542 A | | 4/1943 | Peremi et al. | 268/21 |
| 2,620,523 A | | 12/1952 | Broleman, Jr. | 20/42 |
| 4,605,252 A | * | 8/1986 | Yamamoto | 292/338 |
| 4,860,493 A | | 8/1989 | Lense | 49/279 |
| 4,937,976 A | | 7/1990 | Tucker et al. | 49/345 |
| 6,167,654 B1 | * | 1/2001 | Wolf | 49/357 |

FOREIGN PATENT DOCUMENTS

| | | | |
|---|---|---|---|
| AU | 16932/24 | 3/1924 | |
| DE | 85992 | 7/1920 | |
| DE | 2051000 | 4/1972 | |
| FR | 1306060 | 9/1962 | |
| GB | 11090 | * of 1846 | 49/186 |
| GB | 2022669 | 12/1979 | |
| WO | WO99/28582 | 10/1999 | |

* cited by examiner

*Primary Examiner*—Curtis Cohen
(74) *Attorney, Agent, or Firm*—Eugene Stephens & Associates

(57) ABSTRACT

A cable actuator for a casement sash includes a cable engager that moves against an opening pull cable and diverts the cable to an elongated path when the sash is closed. When the opening pull cable is tensioned to open the sash, this moves the cable back to a shorter tensioned path that moves the cable engager in a way that initiates opening the sash. Thereafter, the sash opens further in response to winding in of the opening pull cable.

12 Claims, 4 Drawing Sheets

CASEMENT SASH CABLE ACTUATOR

TECHNICAL FIELD

Actuators for casement sash.

BACKGROUND

Casement sash, within which are included vertically hinged and horizontally or awning hinged sash, can be opened and closed with cables, as suggested in PCT Publication PCT/AU98/00982. This reference addresses a problem requiring a large pulling force to initiate sash opening when hinge bars for a sash are approximately aligned along a direction of cable pull.

If a cable actuator uses a fixed mechanical advantage from application of motive torque to a shaft the operator can be required to apply substantially increased torque during initial sash opening and then lessened torque during further sash opening. If the mechanical advantage is increased to lessen the initial torque required, then further opening of the sash requires excessive revolutions of the torqued shaft.

The PCT reference proposes a cable actuator solution to this problem. The solution involved sliding a wedge along a hinge track to engage and initiate opening movement of a hinge bar. The invention of this application proposes other solutions also implemented by cable actuators.

SUMMARY OF THE INVENTION

I have devised ways of arranging a casement sash cable actuator so that tensioning an opening pull cable moves the cable from an elongated to a tensioned path in a way that causes initial opening movement of the sash. The cable movement that initiates sash opening applies an increased mechanical advantage during initiation of sash opening when the opening pull cable moves from one path to another. Thereafter, a reduced mechanical advantage applied by a cable winder further opens the sash. This allows an operator to initiate sash opening by using torque no larger than is required for further opening of the sash. The actuator also allows the further sash opening to proceed with only a few turns of applied torque.

My cable actuator achieves these features by using a cable engager that engages an opening pull cable when the sash is closed.

When the opening pull cable is tensioned to open a sash from a closed position, the cable moves the cable engager in a way that initiates sash opening. The cable engager can be a projection fixed to the sash or its hinge bars in a position that is appropriate for engaging the cable, or it can be a pivot arm that the opening pull cable moves to open the sash. In either case, the cable engager forces the opening pull cable into a path that is longer than a tensioned path assumed by the opening pull cable to initiate sash opening. Then as the opening pull cable is tensioned and moves toward the shorter tensioned path, it moves the cable engager away from the elongated path in a way that urges the sash open from a closed position. In effect, such an arrangement applies additional mechanical advantage to the first few degrees of opening of the sash, whereupon the cable actuator proceeds with further opening of the sash at a lesser mechanical advantage.

DRAWINGS

Figure 1:
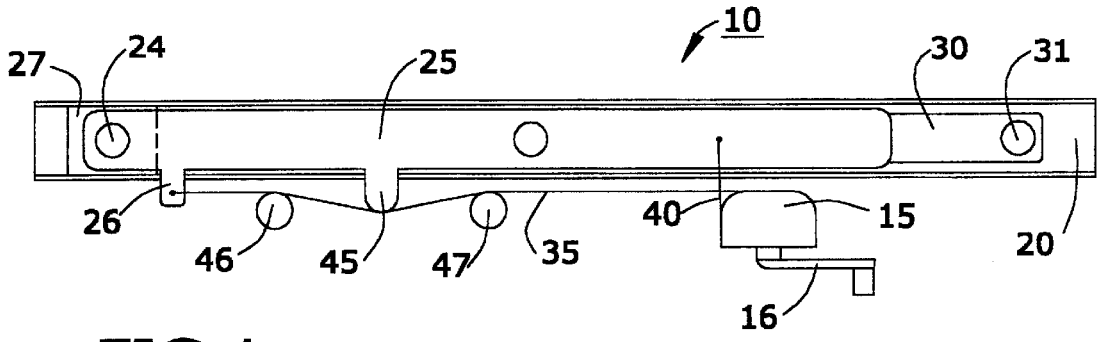
FIGS. 1–3 are partially schematic plan views of a cable actuator arranged for operating a two bar hinge system for opening and closing a casement sash.
Figure 2:
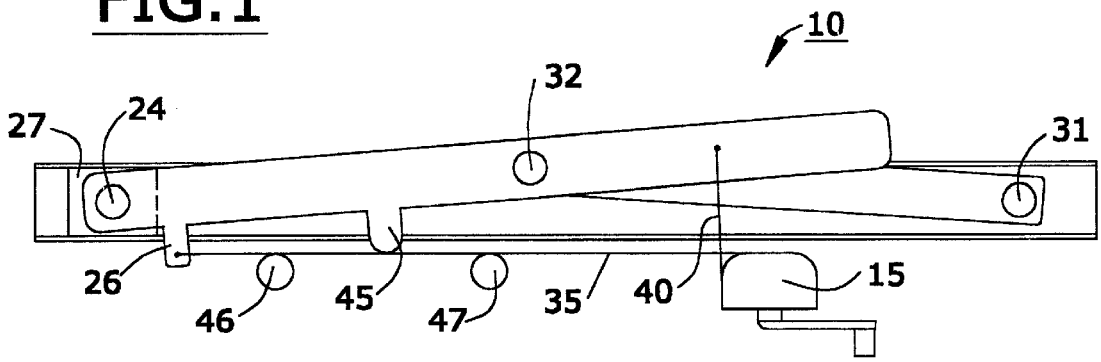
Figure 3:
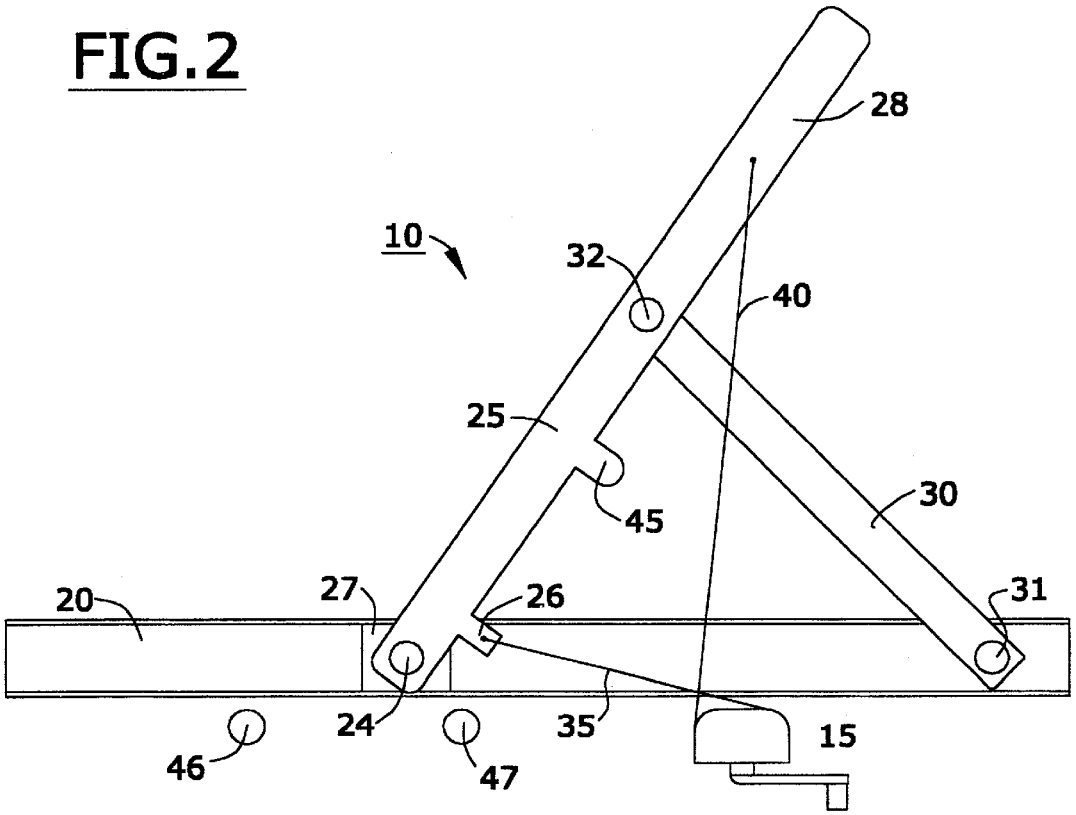
Figure 8:
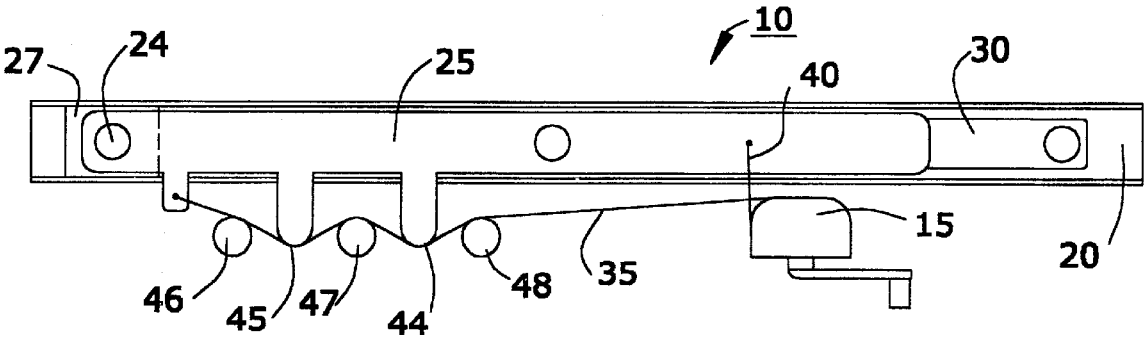

FIG. 8 schematically illustrates one of several preferred variations of the cable actuator embodiment shown in FIGS. 1–3.

Figure 9:
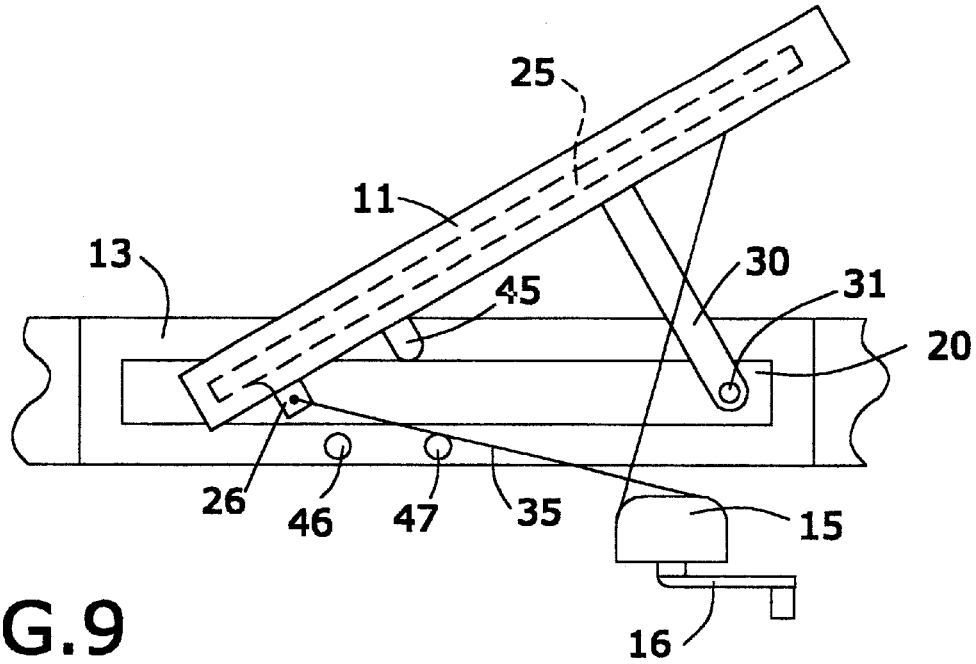

FIG. 9 schematically shows application of the invention to a vertically hinged casement sash.

Figure 10:
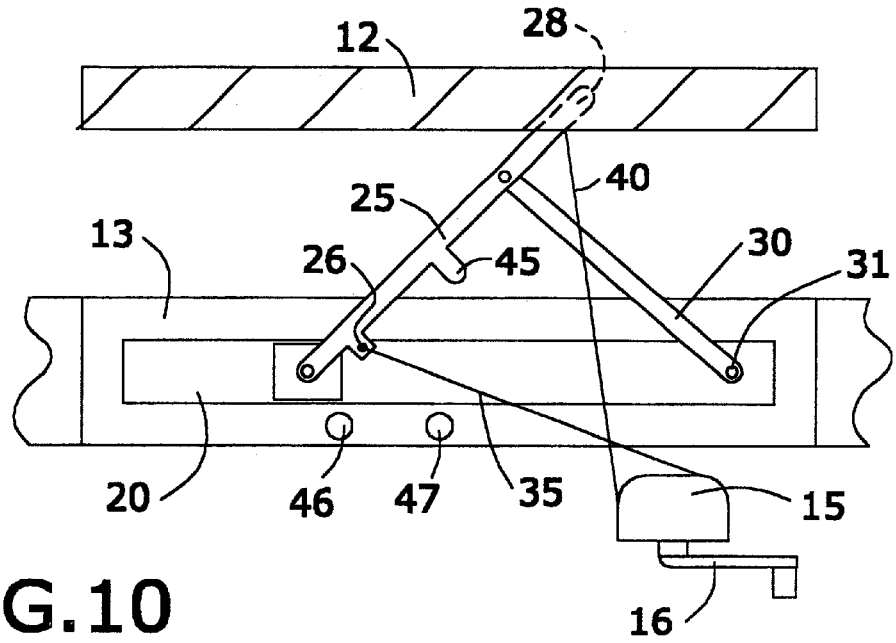

FIG. 10 schematically shows the invention applied to a horizontally or awning hinged casement sash, a bottom sill of which is shown in cross-section.

DETAILED DESCRIPTION

The invention is illustrated as applied to simple two bar hinge systems for casement sash that are hinged either vertically or horizontally. The invention can also be applied to many other hinge arrangements, including more than two hinge bars arranged in a system. Other types of casement sash hinge bar systems should be kept in mind in reading the following description of the invention, since it is possible to apply the invention to a casement sash mounted with many different hinge bar systems.

Two preferred embodiments of the invention as schematically illustrated in FIGS. 1–3 and FIGS. 4–6 are shown for simplicity and clarity as applied to a two bar casement sash hinge system with a sash and casement removed. The missing sash and casement are schematically illustrated in the embodiments of FIGS. 9 and 10 to show application of the invention both to a vertically hinged casement sash, as shown in FIG. 9, and a horizontally or awning hinged casement sash, as shown in FIG. 10. The illustrations are also limited, for simplicity, to two bar hinges that are popular for casement sash, but the invention applies equally well to other casement sash hinge arrangements.

Figure 7:
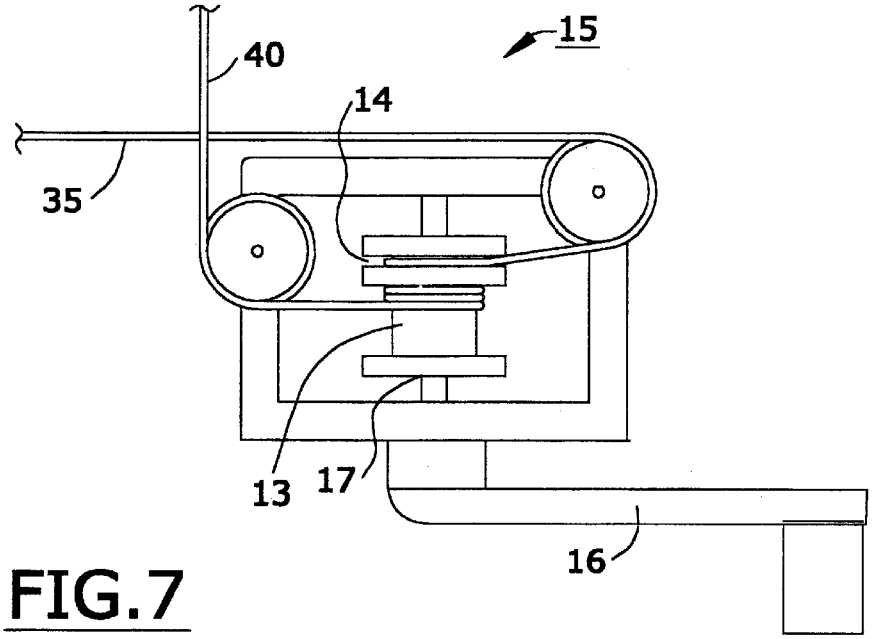
FIG. 7 is a partially schematic, fragmentary plan view of a winder for the cable actuators of FIGS. 1–6.

Actuator 10, as illustrated in FIGS. 1–3 includes a cable winder 15, a hinge track 20, a sash bar 25, and a stay bar 30. Stay bar 30 has a pivotal connection 31 to track 20 at one end, and a pivotal connection 32 to sash bar 25 at its other end. Sash bar 25 has a pivotal connection 24 at its inboard end to a shoe 27 that slides along track 20. The outboard or distal end 28 of sash bar 25 moves outward with an opening sash. Winder 15, which is schematically illustrated in FIG. 7, includes a hand crank 16 applying torque to a winding shaft 17 arranged within winder 15 for paying out and winding in an opening pull cable 35 and a closing pull cable 40. Actuator 10 is shown in the closed sash position in FIG. 1, in the slightly opened sash position in FIG. 2, and in a fully opened sash position in FIG. 3. Opening pull cable 35 is tensioned by winder 15 for drawing a sash open from the position shown in FIG. 1 to the position shown in FIG. 3, and closing pull cable 40 is operated by winder 15 to draw a sash closed from the position of FIG. 3 to the position of FIG. 1.

The increased mechanical advantage that winder 15 applies to opening of a sash from the position of FIG. 1 to the position of FIG. 2 involves cable engager 45 engaging opening pull cable 35. Generally, cable engager 45 urges opening pull cable 35 into an elongated path when a sash moves to a closed position as show in FIG. 1. There are many ways this can be done, but in the arrangement of FIGS. 1–3 this involves cable engager 45 moving between a pair of abutments 46 and 47 that are fixed to a casement as shown in FIGS. 9 and 10. The path of opening pull cable 35 is then elongated by the offset between abutments 46 and 47 as cable 35 extends around a nose or distal end of cable engaging projection 45. The path of opening pull cable 35 is thus longer in its extent between winder 15 and opening lever 26 of sash bar 25 because of the v-shaped path that cable 35 is forced to assume by projection 45.

As winder 15 is rotated to tension opening pull cable 35 for opening a sash, as shown in FIG. 2, opening pull cable moves from the elongated path illustrated in FIG. 1 to a tensioned or shortened path shown in FIG. 2. Such tensioning of opening pull cable 35 pulls the cable taut between abutments 46 and 47 which moves projection 45 to open a sash from a closed position. As this happens, winder 15 pays out slack in closing pull cable 40 to make such sash opening possible.

After opening pull cable 35 reaches its shortened and tensioned path, illustrated in FIG. 2, further tension on opening pull cable 35 moves a sash to a wider opened position as illustrated in FIG. 3. This movement proceeds at a lesser mechanical advantage so that a sash can be opened wide with a reasonably few turns of winder 15. As this happens, a shoe 27 supporting an inner end of sash bar 25 slides along track 20 toward pivot 31 of stay bar 30.

Projection 45 can extend from sash bar 25 as illustrated, and can also extend from sash 11 as shown in FIG. 9. Cable engager 45 can also be arranged to extend from stay bar 30 or some other hinge bar involved with a casement sash, depending on the hinge bar configuration. All that is required is that cable engager 45 be arranged to move into a position when a casement sash closes so as to force opening pull cable 35 into an elongated path.

FIGS. 9 and 10 show how actuator 10 of FIGS. 1–3 can be applied to either a vertically hinged sash 11 to which sash bar 25 is secured, or to a horizontally hinged awning sash 12 to which a free end 28 of sash bar 25 is pivotally connected. In either case, a cable actuator moves sash 11 or sash 12 open and closed relative to a casement 13.

Winder 15, as schematically shown in FIG. 7, preferably includes a winding slot 14 in which opening pull cable is wound upon itself in successive convolutions, and a winding drum 13 on which closing pull cable 40 is wound in adjacent convolutions. Torque applied to winding shaft 17 by either hand crank 16 or by a motor (not shown) turns winding slot 14 and winding drum 13 so as to pay out one cable while reeling in another to accomplish opening and closing of a sash.

Figure 4:
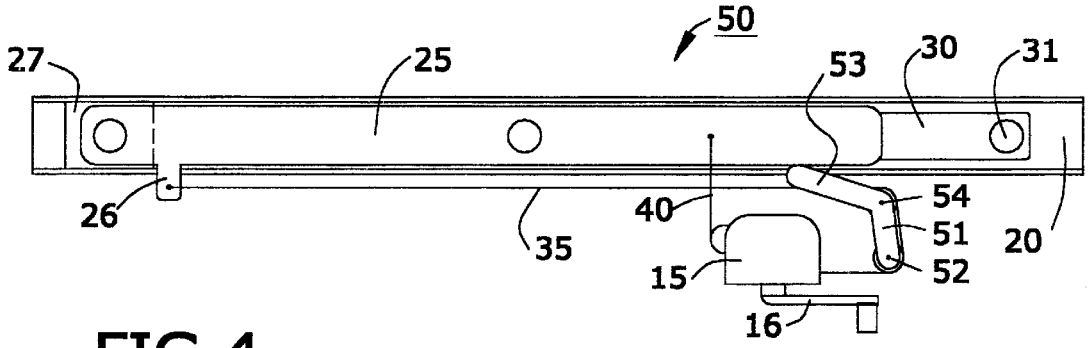
FIGS. 4–6 are partially schematic plan views of an alternative arrangement of an opener applied to a two bar hinge system for a casement sash.
Figure 5:
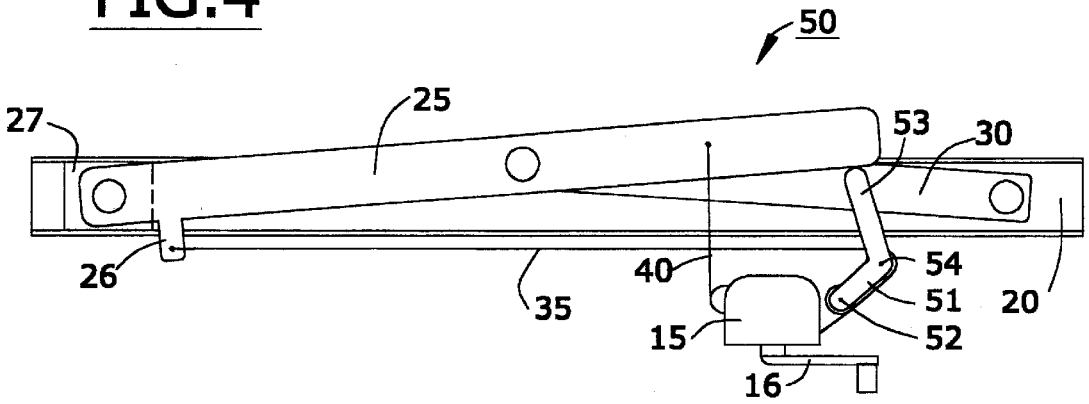
Figure 6:
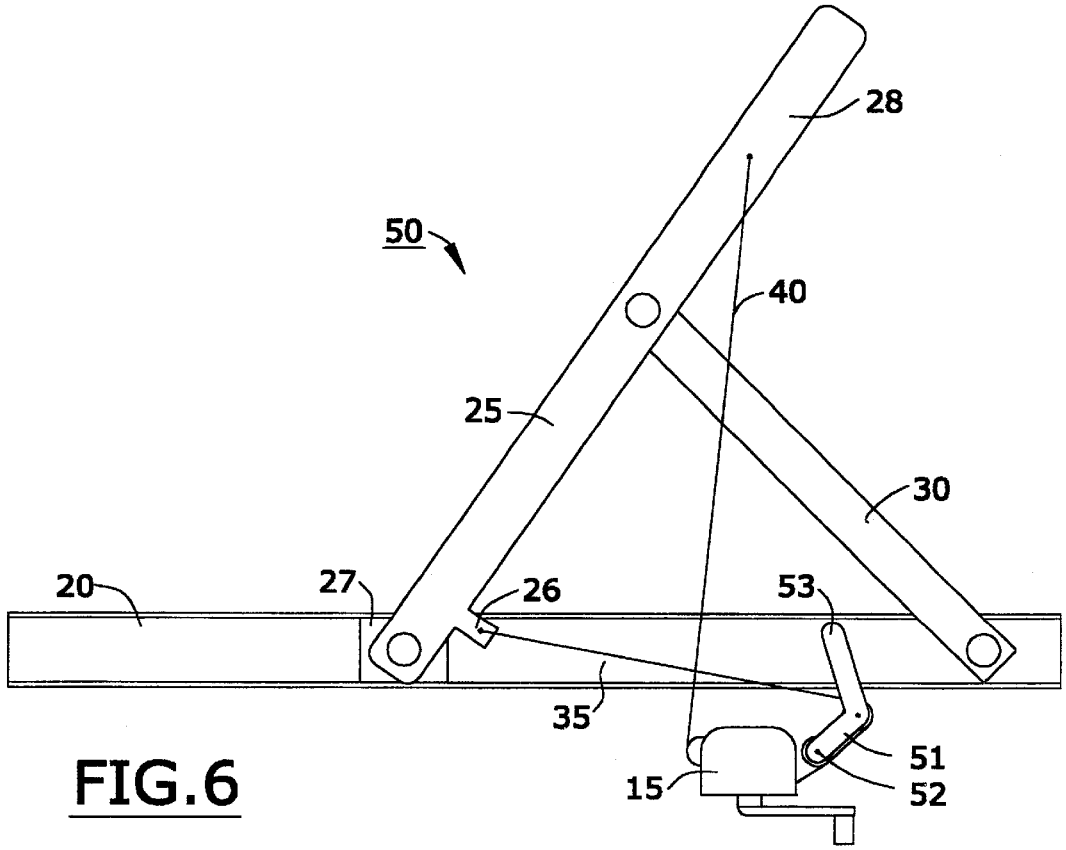

An alternative preferred embodiment of actuator 50 is shown in FIGS. 4–6. It is applied to track 20, sash bar 25, and stay bar 30 and winder 15 in a way similar to actuator 10. Instead of a projection and abutment arrangement to urge opening cable 35 into an elongated path when a sash is closed in the position of FIG. 4, actuator 50 uses a pivot arm 51 mounted along the path of opening pull cable 35. Pivot arm 51 has a cable engaging arm 52 that urges opening cable 35 into an elongated path when a sash is closed, and a sash engaging arm 53 that engages a sash or sash related part, such as sash bar 25 or stay bar 30, when a sash is closed. Arm 51 pivots around pivot 54.

When a sash moves to the closed position of FIG. 4, it engages sash arm 53 and moves pivot arm 51 to the illustrated position in which cable engaging arm 52 urges opening pull cable 35 into an elongated path. When opening pull cable 35 is tensioned by winder 15 to open a sash, this pulls cable 35 to a shorter path moving cable arm 52 to the position shown in FIG. 5. This moves sash arm 53 against a sash or hinge bar to initiate sash opening to the position shown in FIG. 5, as closing pull cable 40 is paid out by winder 15. This opens a sash a few degrees while using a large mechanical advantage derived from initial tensioning of opening pull cable 35. Further opening of the sash can then proceed to the position shown in FIG. 6, and this occurs at a reduced mechanical advantage that moves the sash open with a few turns of winder 15.

When a sash moves back to a closed position by being pulled inward by closing pull cable 40 from the open position of FIG. 6, the sash engages sash arm 53 when it reaches the position of FIG. 5 and pivots arm 51 to the position shown in FIG. 1 when the sash is fully closed. In this position, cable engaging arm 52 moves opening pull cable 35 to an elongated position as previously described.

Actuator 50 of FIGS. 4–6 can be applied to a vertically hinged casement sash 11 as shown in FIG. 9 or to a horizontally or awing hinged sash 12 as shown in FIG. 10 in the same way as actuator 10. Either way, pivot arm 51 is mounted on casement 13 to pivot in response to engagement of its sash arm 53 with sash 11 or 12 or with some component such as sash bar 25 that moves with sash 11 or 12.

Projection 45, which is illustrated in FIGS. 1–3 as extending from sash bar 25 can also extend directly from a sash operated by sash bar 25. Actuator 10 of FIGS. 1–3 and actuator 50 of FIGS. 4–6 have in common that one component involved in forming an elongated path for the opening pull cable as a sash closes is mounted on casement 13, and another component involved in forcing the opening pull cable to an elongated path when a sash closes is mounted on a sash or on something moving with the sash.

Actuator 10 can use a wide variety of sash projections and abutments one of which is shown in FIG. 8. Actuator 10 of FIG. 8 is similar to actuator 10 of FIGS. 1–3 except for using a pair of sash projections 44 and 45 moving across an opening pull cable path between three abutments 46–48 to impose two elongated path offsets on opening pull cable 35. Two projections can also be arranged with two abutments or even a single abutment to accomplish a similar effect. Generally, sash projections arranged farther from a hinge side of a sash or a hinge end 24 of sash bar 25 have a greater mechanical advantage than projections arranged closer to a hinge side of a sash or a hinge end of sash bar 25.

I claim:

1. A cable actuator combined with a casement sash having a sash hinge system movably connecting the sash to a casement, the cable actuator including a cable winder operating an opening pull cable and a closing pull cable to open and close the sash, the cable actuator comprising:

a. a cable engager extending from said sash or a hinge bar for said sash arranged to move into engagement with the opening pull cable as the sash moves to a closed position;

b. engagement of the opening pull cable by the cable engager when the sash reaches a closed position being arranged to force the opening pull cable in a direction substantially perpendicular to an elongated path longer than a shortened path to which the opening pull cable moves when tensioned by the winder to open the sash;

c. movement of the opening pull cable from the elongated path to the shortened path in response to the winder tensioning the opening pull cable being arranged to move the cable engager; and d. movement of the cable engager upon movement of the opening pull cable from the elongated path to the shortened path being arranged to initiate opening of the sash from the closed position.

2. The cable actuator of claim 1 including a fixed abutment arranged on the casement near the closed sash position of the cable engager, the elongated path extending between the fixed abutment and the cable engager.

3. A cable actuator combined with a casement sash having a sash hinge system movably connecting the sash to a casement, the cable actuator including a cable winder operating an opening pull cable and a closing pull cable to open and close the sash, the cable actuator comprising:

a. a cable engager arranged to move into engagement with the opening pull cable as the sash moves to a closed position;

b. engagement of the opening pull cable by the cable engager when the sash reaches a closed position being arranged to force the opening pull cable into an elongated path longer than a shortened path to which the opening pull cable moves when tensioned by the winder to open the sash;

c. movement of the opening pull cable from the elongated path to the shortened path in response to the winder tensioning the opening pull cable being arranged to move the cable engager;

d. movement of the cable engager upon movement of the opening pull cable from the elongated path to the shortened path being arranged to initiate opening of the sash from the closed position; and e. the cable engager includes a pivot arm that the opening pull cable moves to open the sash as the opening pull cable moves from the elongated path to the shortened path.

4. A cable actuator combined with a casement sash having a sash hinge system movably connecting the sash to a casement, the cable actuator including a cable winder operating an opening pull cable and a closing pull cable to open and close the sash, the cable actuator comprising:

a. a cable engager arranged to move into engagement with the opening pull cable as the sash moves to a closed position;

b. engagement of the opening pull cable by the cable engager when the sash reaches a closed position being arranged to force the opening pull cable into an elongated path longer than a shortened path to which the opening pull cable moves when tensioned by the winder to open the sash;

c. movement of the opening pull cable from the elongated path to the shortened path in response to the winder tensioning the opening pull cable being arranged to move the cable engager;

d. movement of the cable engager upon movement of the opening pull cable from the elongated path to the shortened path engages and initiates opening of the sash from the closed position; and e. the opening pull cable is arranged relative to the cable engager so that winding torque applied to the winder to tension the opening pull cable and move the cable engager to initiate opening of the sash from the closed position is no larger than torque applied to the winder for further opening the sash to positions moving the cable engager out of engagement with the opening pull cable.

5. A casement sash cable actuator in combination with a window sash, said actuator using a cable winder winding an opening pull cable and a closing pull cable, the cable actuator comprising:

a. a sash opener extending from said sash or a hinge bar for said sash arranged to engage the opening pull cable when the sash is closed so as to urge the opening pull cable in a direction substantially perpendicular to an elongated path;

b. the opening pull cable being arranged so that when tensioned by the winder for opening the sash, the opening pull cable moves from the elongated path to a shortened path; and c. movement of the opening pull cable from the elongated path to the shortened path moves the sash opener in a way that initiates opening of the sash.

6. The cable actuator of claim 5 wherein a fixed abutment engages the opening pull cable in the elongated path.

7. A casement sash cable actuator in combination with a window sash, said actuator using a cable winder winding an opening pull cable and a closing pull cable, the cable actuator comprising:

a. a sash opener arranged to engage the opening pull cable when the sash is. closed so as to urge the opening pull cable into an elongated path;

b. the opening pull cable being arranged so that when tensioned by the winder for opening the sash, the opening pull cable moves from the elongated path to a shortened path;

c. movement of the opening pull cable from the elongated path to the shortened path moves the sash opener in a way that initiates opening of the sash; and d. the sash opener includes a pivot lever that engages and initiates opening of the sash when the opening pull cable moves to the shortened path.

8. A casement sash cable actuator in combination with a window sash, said actuator using a cable winder winding an opening pull cable and a closing pull cable, the cable actuator comprising:

a. a sash opener arranged to engage the opening pull cable when the sash is closed so as to urge the opening pull cable into an elongated path;

b. the opening pull cable being arranged so that when tensioned by the winder for opening the sash, the opening pull cable moves from the elongated path to a shortened path;

c. movement of the opening pull cable from the elongated path to the shortened path moves the sash opener to engage and initiate opening of the sash; and d. torque applied to the cable winder in tensioning the opening pull cable to move the sash opener does not exceed torque applied by the winder to the cable opener to open the sash further.

9. In a casement sash cable actuator and a window sash, said actuator using a winder and a cable arranged so that one end region of the cable serves as a opening pull for said sash and an opposite end region of the cable serves as a closing pull for said sash, the improvement comprising:

a. a sash opener extending from said sash or a hinge bar for engaging the opening pull cable so that as the sash approaches a closed position, the sash opener urges the opening pull cable in a direction substantially perpendicular to an elongated path; and b. the opening pull cable being arranged in the elongated path when the sash is closed so that tension applied by the winder to the opening pull cable to open the sash moves the opening pull cable from the elongated path to the shortened path in a way that moves the sash opener to initiate opening of the sash from the closed position.

10. The improvement of claim 9 including a fixed abutment engaging the opening pull cable in the elongated path.

11. In a casement sash cable actuator and a window sash, said actuator using a winder and a cable arranged so that one end region of the cable serves as a opening pull for said sash and an opposite end region of the cable serves as a closing pull for said sash, the improvement comprising:

a. a sash opener engaging the opening pull cable so that as the sash approaches a closed position, the sash opener urges the opening pull cable to an elongated path;

b. the opening pull cable being arranged in the elongated path when the sash is closed so that tension applied by the winder to the opening pull cable to open the sash moves the opening pull cable from the elongated path to the shortened path in a way that moves the sash opener to engage and initiate opening of the sash from the closed position; and c. the winder, the cable end regions, and the sash opener are arranged so that torque required for turning the winder is substantially constant throughout opening and closing of a sash.

12. In a casement sash cable actuator and a window sash, said actuator using a winder and a cable arranged so that one end region of the cable serves as a opening pull for said sash and an opposite end region of the cable serves as a closing pull for said sash, the improvement comprising:

a. a sash opener engaging the opening pull cable so that as the sash approaches a closed position, the sash opener urges the opening pull cable to an elongated path;

b. the opening pull cable being arranged in the elongated path when the sash is closed so that tension applied by the winder to the opening pull cable to open the sash moves the opening pull cable from the elongated path to the shortened path in a way that moves the sash opener to engage and initiate opening of the sash from the closed position; and c. the sash opener is pivotally mounted and includes a sash arm and a cable arm engaging the opening pull cable to be moved when the opening pull cable is tensioned in a way that moves the sash arm against the sash and urges the sash open from the closed position.

* * * * *